United States Patent [19]

Barannik et al.

[11] 4,059,372

[45] Nov. 22, 1977

[54] PLANT FOR PRODUCING METALLIC PELLETS FROM SALT-ADDED MAGNESIUM OR ALLOYS THEREOF

[76] Inventors: Ivan Andreevich Barannik, prospekt Lenina, 182a, kv. 22, Zaporozhie; Anatoly Borisovich Kondratenko, ulitsa Sevastopolskaya, 4, kv. 6, Kalush Ivano-Frankovskoi oblasti; Alexandr Fedorovich Trukhin, ulitsa Zhdanova, 11, kv. 32, Kalush Ivano-Frankovskoi oblasti; Viktor Georgievich Raskatov, ulitsa Khimikov, 14, kv. 18, Kalush Ivano-Frankovskoi oblasti; Ivan Vasilievich Zharovsky, ulitsa Zhdanova, 11, kv. 32, Kalush-Ivano-Frankovskoi oblasti; Viktor Alexandrovich Rudakov, ulitsa Bogdana Khmelnitskogo, 60, kv. 121, Kalush Ivano-Frankovskoi oblasti; Andrei Efremovich Mordkovich, ulitsa 40 let Sovetskoi Ukrainy, 29, kv. 13; Alexandr Vasilievich Chalov, ulitsa 40 let Sovetskoi Ukrainy, 46, kv. 20, both of Zaporozhie, all of U.S.S.R.

[21] Appl. No.: 747,814

[22] Filed: Dec. 6, 1976

[30] Foreign Application Priority Data

Dec. 5, 1975 U.S.S.R. ..... 2196202

[51] Int. Cl.[2] ..... B29C 23/00

[52] U.S. Cl. ..... 425/8; 264/8

[58] Field of Search ..... 425/6, 8, 215–217; 264/8; 23/259.7

[56] References Cited

U.S. PATENT DOCUMENTS

| | | | |
|---|---|---|---|
| 1,601,897 | 10/1926 | Wiley et al. | 425/8 X |
| 2,439,776 | 4/1948 | Klein et al. | 425/8 |
| 3,721,511 | 3/1973 | Schlienger | 425/8 |

*Primary Examiner*—Robert L. Spicer, Jr.

*Attorney, Agent, or Firm*—Lackenbach, Lilling & Siegel

[57] ABSTRACT

The plant for producing metallic pellets from a salt-added magnesium or alloys thereof comprises a metal-melting furnace, a centrifugal pelletizer with a perforated bowl and a cylindrical pellet-collecting chamber. A hopper is provided in said cylindrical chamber to divide the latter into two concentric zones open from below, of which one zone is adapted for collecting salvage resulting from the pellet formation process, while the other zone is for pellet collection. Provision of said zones makes it possible to considerably reduce the content of salts in magnesium pellets or in those of alloys thereof, as a great proportion of the salts get into the hopper and is withdrawn from the chamber as process waste, whereas the magnesium pellets settle down in the other zone and are then forwarded for further processing.

3 Claims, 3 Drawing Figures

PLANT FOR PRODUCING METALLIC PELLETS FROM SALT-ADDED MAGNESIUM OR ALLOYS THEREOF

The present invention relates generally to the art of pelletized material production, and more specifically it concerns plants for producing metallic pellets from salt-added magnesium or alloys thereof.

There are a number of plant methods used for producing metallic pellets, such as aluminum ones, or pelletized fertilizers. One known plant comprises a furnace, centrifugal pelletizer with a perforated bowl, and a cylindrical chamber for collecting the pellets.

Inasmuch as some branches of engineering industries have become at the present time large-scale consumers of pelletized magnesium and its alloys, a plant has been provided for producing the latter, said plant comprising, like the heretofore known ones, a furnace for melting salt-added metal, a centrifugal pelletizer with a perforated bowl and a cylindrical chamber for collecting the pellets formed from molten metal when the latter is shot out through the perforations in the bowl of the centrifugal pelletizer. However, trial tests of said plant have shown it not to be well suited for pelletizing by spraying molten magnesium mixed with a salt additive. This is due to the fact that when a salt-added magnesium is sprayed the magnesium pellets thus formed become saturated with hygroscopic salts that form part of said salt additive, which adversely affects the characteristics of the final product. Moreover, salts present in the pelletized magnesium as final particles, can clog up screen apertures in the course of pellet screening, thus adversely affecting the screen efficiency.

Some deviations from the pellet production process parameters may result in formation of oblong (needle-like) pellets, as well as in their fusing together and sticking to the chamber bottom. This impedes the discharge of magnesium pellets from the chamber as fast as they form or renders it practically impossible.

It is a primary object of the present invention to provide a plant for producing metallic pellets from a salt-added magnesium or alloys thereof that would provide for separating a principal part of the salt additive from the magnesium pellets during their formation which would make it possible to add much to the properties of the product obtained and heighten the efficiency of the plant.

Said object is accomplished in a plant, wherein according to the invention, a hopper is provided in the cylindrical chamber thereof, located under the perforated bowl concentrically therewith and adapted to partition said chamber into two concentric zones open from below. One of said zones established by the hopper, is located centrally in the chamber and is adapted for collecting salvage and abnormally fine pellets, while the other, annular shaped zone arranged along the periphery of the chamber, is adapted for collecting the pellets, the former zone being provided with a salvage disposal mechanism and the latter, with a pellet withdrawal mechanism, both mechanisms being located under the respective zones.

Such a constructional arrangement of the chamber conforms most completely to the present process for producing pellets from a salt-added magnesium or alloys thereof. Partitioning the chamber into two zones reduces the salt content in the pellets formed from magnesium or its alloys, since a great proportion of said salts get in the hopper and are disposed therefrom as process waste, whereas magnesium pellets are fed along the annular gap in the bottom portion of the second zone to get into the mechanism for their withdrawal, from whence they are delivered for further processing.

The invention is characterized also in that the annular zone of the chamber is bounded from inside by a sloping piece shaped as the frustum of a cone and attached with its smaller base to the top edge of the hopper.

This enables the plant production area to be reduced and facilitates attendance of the chamber bottom portion; besides, this makes it possible to considerably reduce the volumetric size of the chamber and attain the most rational distribution of air stream inside the chamber for more effective cooling of the pellets as they form.

The invention is characterized also by the fact that the mechanism for withdrawing the pellets comprises a stationary fixed water-cooled circular trough with at least one discharge port, and a horizontally rotatable ring arranged concentrically to the trough and carrying rakes accommodated in the latter. Such a mechanism provides for a dependable plant operation for prolonged periods of time, as the rakes are capable of handling pellets of any shape and size located in the trough, as well as those that are stuck to the bottom of the trough. Operating reliability of the mechanism is ensured also by providing water cooling to the trough which prevents heat deformation from the hot magnesium pellets.

In what follows the present invention is disclosed in a detailed description of a specific embodiment thereof given by way of example with reference to the accompanying drawings, wherein.

Figure 1:
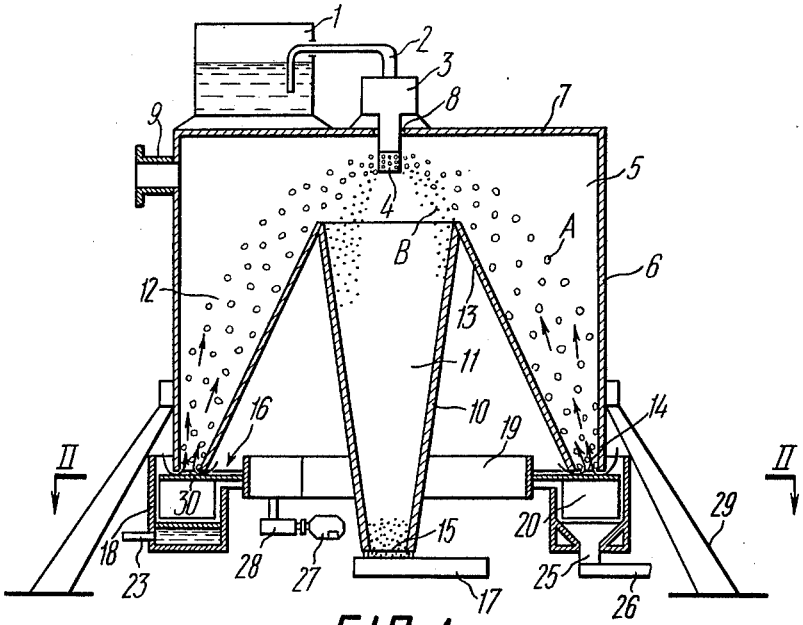
FIG. 1 is a schematic fragmentary longitudinal section view of a plant, according to the invention.

Reference being now directed to the accompanying drawings, the plant for producing metallic pellets from a salt-added magnesium or alloys thereof comprises the following components of the heretofore known construction: a furnace 1 for melting magnesium and the flux containing process salt additives, a bottom gate 2 to feed molten magnesium charge with salt additives to a centrifugal pelletizer 3 having a perforated bowl 4 and the drive to impart rotary motion thereto, and a cylindrical chamber 5 for collecting magnesium pellets.

The chamber 5 is defined by a cylindrical wall 6 and a top cover 7 carrying the furnace 1 and the centrifugal pelletizer 3. An opening 8 is provided in the top cover 7 for the perforated bowl 4 of the pelletizer 3 to insert into the chamber 5, as well as some other openings for any process equipment (such as gas burners, monitoring equipment, ventilation appliances to withdraw air from the chamber, etc.) to introduce therethrough, said openings being not shown in FIG. 1 so as not to obscure the latter. An outlet 9 is provided in the top portion of the wall 6 to vent out hot air from the chamber 5.

A hopper 10 is vertically arranged in the chamber 5 under the perforated bowl 4 in a spaced coaxial position with respect to the latter, said bowl being shaped as an inverted frustum of a cone as shown in FIG. 1, or having a similar shape, say, funnel-like.

The hopper 10 partitions the chamber 5 into two concentric zones 11 and 12 open from below. The zone 11 established by the hopper 10 itself, is located centrally in the chamber 5 and is adapted for collecting salvage and undersized pellets, while the annular zone 12, located along the periphery of the chamber 5, is intended for collecting the pellets.

The zone 12 is bounded from inside, i.e., on the side of the hopper 10, by an inclined cone-shaped piece 13 which forms the frustum of a cone inside the chamber, the smaller base of said frustum being attached to the top edge of the hopper 10. As the piece 13 is in fact a wall, the zone 12 is confined between the side wall 6 of the chamber 5 and the piece 13.

Inasmuch as the zones 11 and 12 are open from below, the shaped pellets are withdrawn from the zone 12 through an annular gap 14, whereas the salvage is disposed from the zone 11 through a bottom outlet 15. Provided under said zones at the place of the annular gap 14 and the bottom outlet 15 are, respectively, a mechanism 16 for withdrawal of pellets and a salvage disposal mechanism 17.

The salvage disposal mechanism 17 may be of any construction known heretofore and suitable for the purpose.

Figure 2:
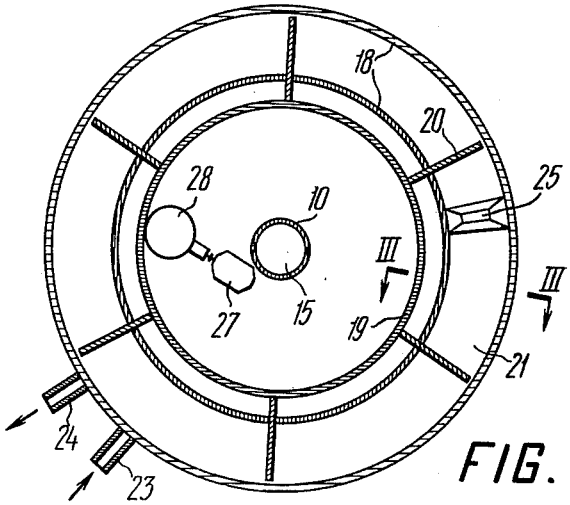
FIG. 2 is a section taken along the line II—II in FIG. 1.
Figure 3:
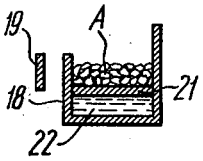
FIG. 3 is a section taken along the line III—III in FIG. 2.

The pellet withdrawal mechanism 16 comprises a stationary-fixed water-cooled trough 18 and a horizontally rotatable ring 19 carrying rakes 20 accommodated in the trough 18 and made fast on the ring 19. The trough 19 is located just under the annular gap 14 and is ring-shaped as shown in FIG. 2. A duct 22 is provided under a bottom 21 (FIG. 3) of the trough 18 for water cooling the bottom 21 to circulate, thereby preventing local deformation of the trough at the places where the pellets accumulate. A water inlet 23 and a water outlet 24 (FIG. 2) are provided on the trough to provide water into and let it out therefrom. Besides, a discharge port 25 is provided in the bottom 21 through which pellets are gravity discharged into any heretofore known conveying mechanism 26 (FIG. 1) to be forwarded for further processing.

The ring 19 (FIG. 2) is arranged concentrically with the trough 18 either internally (which is the case in FIG. 2) or externally (not shown) to said trough, and may have a diverse cross-sectional configuration (such as sheet, I-beam, channel, angle, etc.). The ring 19 is rotated from an electric motor through a frictional mechanism 28 of any type now in use.

The chamber 5 (see FIG. 1), the trough 18 and the motor 27 are mounted on a stationary-fixed base 29.

To provide a continuous cooling of the pellets being formed, air is permanently drawn out from the chamber 5 through the outlet 9, said air being drawn into the chamber through a gap 30 defined between the trough 18 and the chamber 5.

The herein-proposed plant operates as follows.

Magnesium or an alloy thereof together with a salt additive is charged into the furnace 1, where it is melted and heated to a preset temperature. The liquid magnesium or its alloy together with the salt additive is fed through the bottom gate 2 into the centrifugal pelletizer 3. Forasmuch as the latter rotates, liquid metal together with the salt additive is expelled, by virtue of centrifugal force, through the perforations in the bowl 4 as fine streams. Such streams of metal coated with the salt additive fly, for the greater part, over the hopper 10 and, upon reaching zone 12, are split into minute particles after having encountered the streams of air drawn out from the chamber 5. The thus formed particles then crystallize into pellets A.

The size of the pellets A is defined by the initial angular velocity of flight of the particles and by the diameter of perforations in the bowl 4.

The pellets 5 coated with the salt additive as an envelope protecting them against oxidation by atmospheric oxygen, cool down when flying along their path in the zone 12, slide down over the walls 6 and 13 to get through the annular gap 14 into the trough 18, wherein the pellets A are handled by the rakes 20 to move towards the discharge port 25 and therethrough into the conveying mechanism 26.

It may happen that some oversized pellets form among the pellets A, that have not had sufficient time to crystallize until reaching the trough 18. This is why some caked pellets are liable to arise in certain places, which are easy to disintegrate under the mechanical action of the rakes 20.

Therefore, upon reaching the trough a layer of the magnesium pellets is not only conveyed by the rakes towards the discharge port 25 but is also well agitated to disintegrate the agglutinated pellets which adds to the yield of the sound product and facilitates the operation of the process equipment at further processing stages.

The waste product B (salvage) resulting from pellet formation which is present as superfine (undersized) pellets, as well as surplus particles of the salt additive that have not been utilized for formation of a protective coating on the pellet surface, are atomized as an independent phase consisting of fine particles 0.1 to 1.0 mm in diameter.

Such particles settle down largely within the zone 11, i.e., in the hopper 10 located centrally in the chamber 5, and penetrate through the bottom outlet 15 into the disposal mechanism 17.

We claim:

1. A plant for producing metallic pellets from a salt-added magnesium or alloys thereof, comprising: a furnace for melting a salt-added metal; a centrifugal pelletizer with a perforated bowl; a means for feeding the molten metal together with the salt additive to said centrifugal pelletizer; a cylindrical chamber accommodating the perforated bowl of said centrifugal pelletizer and adapted for collecting the pellets formed from the molten metal when the latter is shot out through the perforations in said bowl; a hopper provided in said cylindrical chamber under the coaxially with the perforated bowl; said hopper dividing said cylindrical chamber into two concentric zones open from below, of which one zone established by said hopper is located centrally in said chamber and is adapted for collecting salvage that results from the pellet formation process, while the other annular-shaped zone is located along the periphery of said chamber and is adapted for pellet collection; a pellet withdrawal mechanism provided under said latter zone; a salvage disposal mechanism provided under said former zone.

2. A plant as claimed in claim 1, wherein the annular zone of the chamber is confined from within by an inclined cone-shaped piece with its smaller base held to the top hopper edge.

3. A plant as claimed in claim 1, wherein the pellet withdrawal mechanism comprises a stationary-fixed water-cooled annular trough having at least one discharge port, and a horizontally rotatable ring concentric with the trough and carrying rakes accommodated in the trough.

* * * * *